US009895670B2

(12) United States Patent
Anders et al.

(10) Patent No.: US 9,895,670 B2
(45) Date of Patent: Feb. 20, 2018

(54) HEAD FOR A MIXING APPARATUS

(71) Applicant: Heathrow Scientific LLC, Vernon Hills, IL (US)

(72) Inventors: Mark W. Anders, Tai Po (HK); Alice M. Jandrisits, Des Plaines, IL (US)

(73) Assignee: HEATHROW SCIENTIFIC LLC, Vernon Hills, IL (US)

( * ) Notice: Subject to any disclaimer, the term of this patent is extended or adjusted under 35 U.S.C. 154(b) by 115 days.

(21) Appl. No.: 14/633,939

(22) Filed: Feb. 27, 2015

(65) Prior Publication Data

US 2016/0250608 A1 Sep. 1, 2016

(51) Int. Cl.

| | |
|---|---|
| ***B01F 11/00*** | (2006.01) |
| ***B01L 9/00*** | (2006.01) |
| ***B01L 9/06*** | (2006.01) |
| ***B04B 5/04*** | (2006.01) |
| ***B04B 7/08*** | (2006.01) |

(52) U.S. Cl.

CPC ..... *B01F 11/0008* (2013.01); *B01L 9/06* (2013.01); *B01L 9/523* (2013.01); *B04B 5/0414* (2013.01); *B04B 7/08* (2013.01); *B01L 2200/023* (2013.01); *B01L 2300/123* (2013.01); *B01L 2400/0409* (2013.01)

(58) Field of Classification Search

CPC .. B01F 11/0008; B01F 11/0014; B06B 1/167; B01L 9/06; B01L 9/523

See application file for complete search history.

(56) References Cited

U.S. PATENT DOCUMENTS

| | | | | |
|---|---|---|---|---|
| 2,809,020 A | | 10/1957 | Magee et al. | |
| 3,163,404 A | * | 12/1964 | Kraft | B01F 9/002 366/214 |
| 3,430,926 A | | 3/1969 | Freedman et al. | |
| 3,850,580 A | | 11/1974 | Moore et al. | |
| 4,118,801 A | | 10/1978 | Kraft et al. | |
| 4,555,183 A | | 11/1985 | Thomas | |

(Continued)

FOREIGN PATENT DOCUMENTS

| | | |
|---|---|---|
| EP | 1352684 | 10/2003 |
| JP | 2007237173 | 9/2007 |

(Continued)

*Primary Examiner* — Tony G Soohoo
*Assistant Examiner* — Anshu Bhatia
(74) *Attorney, Agent, or Firm* — Michael Best & Friedrich LLP

(57) ABSTRACT

A head that can be coupled with a mixing apparatus includes a body that defines a longitudinal axis and includes a first side, a second side, a third side, and a fourth side. Each of the sides includes a projection. The body is configured to receive a microplate between the sides, which is removably secured to the body by the projections. At least one vertical channel in the body is configured to removably secure a first test tube to the body so that the longitudinal axis of the tube is perpendicular to the longitudinal axis of the body. The first vertical channel has a first diameter. At least one horizontal channel in the body is configured to removably secure a second test tube so that the longitudinal axis of the tube is parallel to the longitudinal axis of the body. The first test tube and the second test tube can be coupled to the body at the same time.

8 Claims, 10 Drawing Sheets

(56) References Cited

U.S. PATENT DOCUMENTS

| | | | | |
|---|---|---|---|---|
| 6,579,002 | B1 * | 6/2003 | Bartick | B01F 11/0008 366/112 |
| 6,709,148 | B2 | 3/2004 | Glass | |
| 6,908,223 | B2 | 6/2005 | Bibbo et al. | |
| 6,923,567 | B2 | 8/2005 | Bibbo et al. | |
| 6,981,794 | B2 | 1/2006 | Bibbo et al. | |
| 6,988,825 | B2 | 1/2006 | Coville et al. | |
| 7,168,459 | B2 | 1/2007 | Bibbo et al. | |
| 7,364,350 | B2 | 4/2008 | Coville et al. | |
| D607,476 | S | 1/2010 | Saul | |
| D609,255 | S | 2/2010 | Bare et al. | |
| 7,654,729 | B2 | 2/2010 | Passoni | |
| D640,898 | S | 7/2011 | Sandor et al. | |
| 8,367,024 | B2 | 2/2013 | Itoh | |
| D692,161 | S | 10/2013 | Okuda et al. | |
| 8,550,696 | B2 | 10/2013 | Ebers et al. | |
| 8,574,515 | B2 | 11/2013 | Ellis et al. | |
| D705,829 | S | 5/2014 | Aeberhard | |
| D746,883 | S | 1/2016 | Strommer et al. | |
| 9,227,162 | B2 | 1/2016 | Gramann et al. | |
| 2003/0214876 | A1 | 11/2003 | Glass | |
| 2004/0013576 | A1 | 1/2004 | Gfrorer et al. | |
| 2004/0022123 | A1 | 2/2004 | Coville et al. | |
| 2006/0187743 | A1 | 8/2006 | Carreras | |
| 2010/0046323 | A1 | 2/2010 | Tien et al. | |
| 2013/0044559 | A1 | 2/2013 | Ashe et al. | |

FOREIGN PATENT DOCUMENTS

| | | |
|---|---|---|
| JP | 2010078483 | 4/2010 |
| JP | 2010201396 | 9/2010 |
| WO | 1998031457 | 7/1998 |
| WO | 2011124365 | 10/2011 |

* cited by examiner

HEAD FOR A MIXING APPARATUS

BACKGROUND

The present invention relates to a mixing apparatus such as a centrifuge or shaker. In particular, the invention relates to a head that can be coupled to a mixing apparatus and configured to receive either a microplate or test tubes.

SUMMARY

In one embodiment, the invention provides a head that can be coupled with a mixing apparatus. The head includes a body that defines a longitudinal axis and includes a plurality of sides that are deformable and are spaced to permit frictional engagement of a microplate between them. The head also includes at least one vertical channel that is configured to removably secure a test tube to the body so that a longitudinal axis of the test tube orients in a direction perpendicular to the longitudinal axis of the body, and at least one horizontal channel that is configured to removably secure a test tube to the body so that a longitudinal axis of the test tube orients in a direction parallel to an axis of the horizontal channel.

In another embodiment, the invention provides a head that can be coupled with a mixing apparatus. The head includes a body that defines a longitudinal axis and a first side, a second side, a third side, and a fourth side that each includes a projection. The body includes a central member for supporting a microplate between the sides. The head includes a first vertical channel, a second vertical channel, a third vertical channel, and a fourth vertical channel. The first vertical channel is configured to removably secure a first test tube to the body in a direction so that a longitudinal axis of the test tube is perpendicular to the longitudinal axis of the body. The second vertical channel is configured to removably secure a second test tube to the body in a direction so that a longitudinal axis of the test tube is perpendicular to the longitudinal axis of the body. The first horizontal channel is configured to removably secure a third test tube to the body in a direction so that a longitudinal axis of the test tube is parallel to the longitudinal axis of the body. The second horizontal channel configured to removably secure a fourth test tube to the body in a direction so that a longitudinal axis of the test tube is perpendicular to the longitudinal axis of the body. The first test tube, the second test tube, the third test tube, and the fourth test tube can be coupled to the body at the same time.

Other aspects of the invention will become apparent by consideration of the detailed description and accompanying drawings.

DETAILED DESCRIPTION

Figure 1:
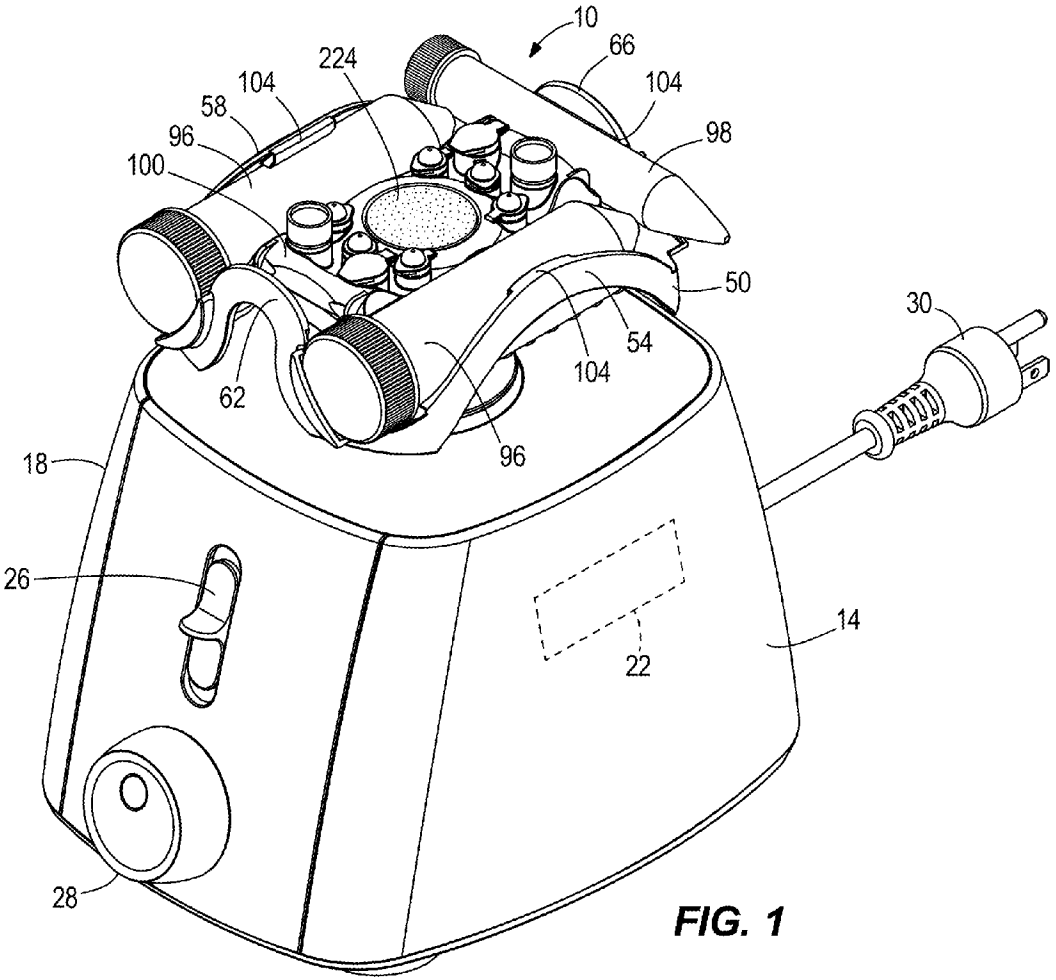
FIG. 1 is a perspective view of a mixing apparatus with a head having a plurality of test tubes secured thereto according to a first embodiment of the invention.
Figure 1A:
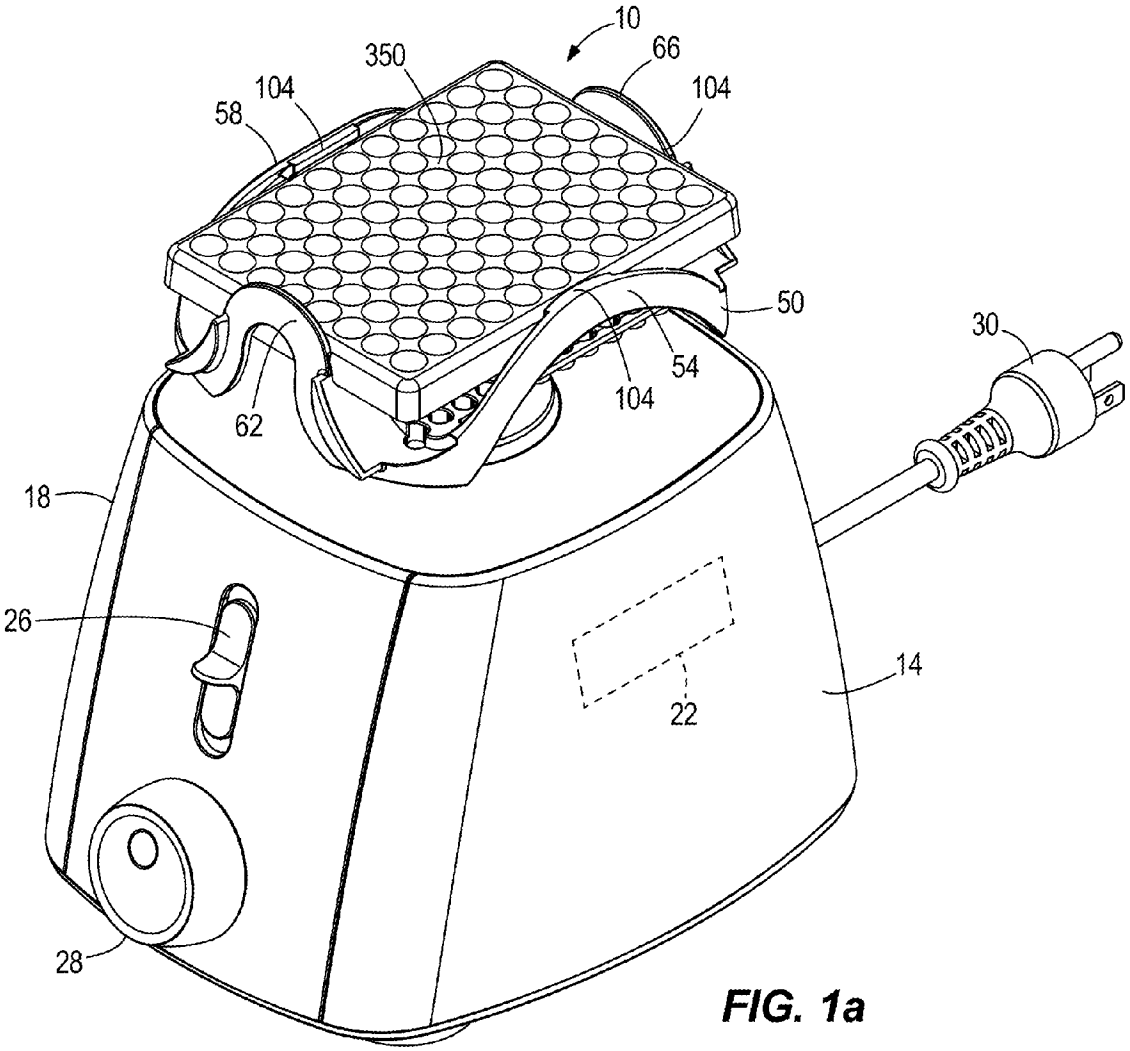
FIG. 1*a* is a perspective view of the mixing apparatus with the head of FIG. 1 having a microplate secured thereto.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-11 illustrate a head 10 that can be coupled to a mixing apparatus 14 (e.g., a centrifuge, shaker, etc.). The mixing apparatus 14 includes a housing 18 that encloses a motor 22. A rotor post sub-assembly 20 (FIG. 3) is located in the housing 18. The housing 18 includes a three-position switch or button 26 that actuates the motor 22 and an actuator or dial 28 that varies the speed of the motor 22. The three-positions of the switch 26 include "off," "on," and "intermittently on." In the illustrated embodiment, the housing 18 includes a power supply that provides alternating current (AC) power via a corded plug 30 electrically coupled to a wall outlet. In other embodiments, the power supply may be a battery pack or any number of suitable powering options, however.

Figure 2:
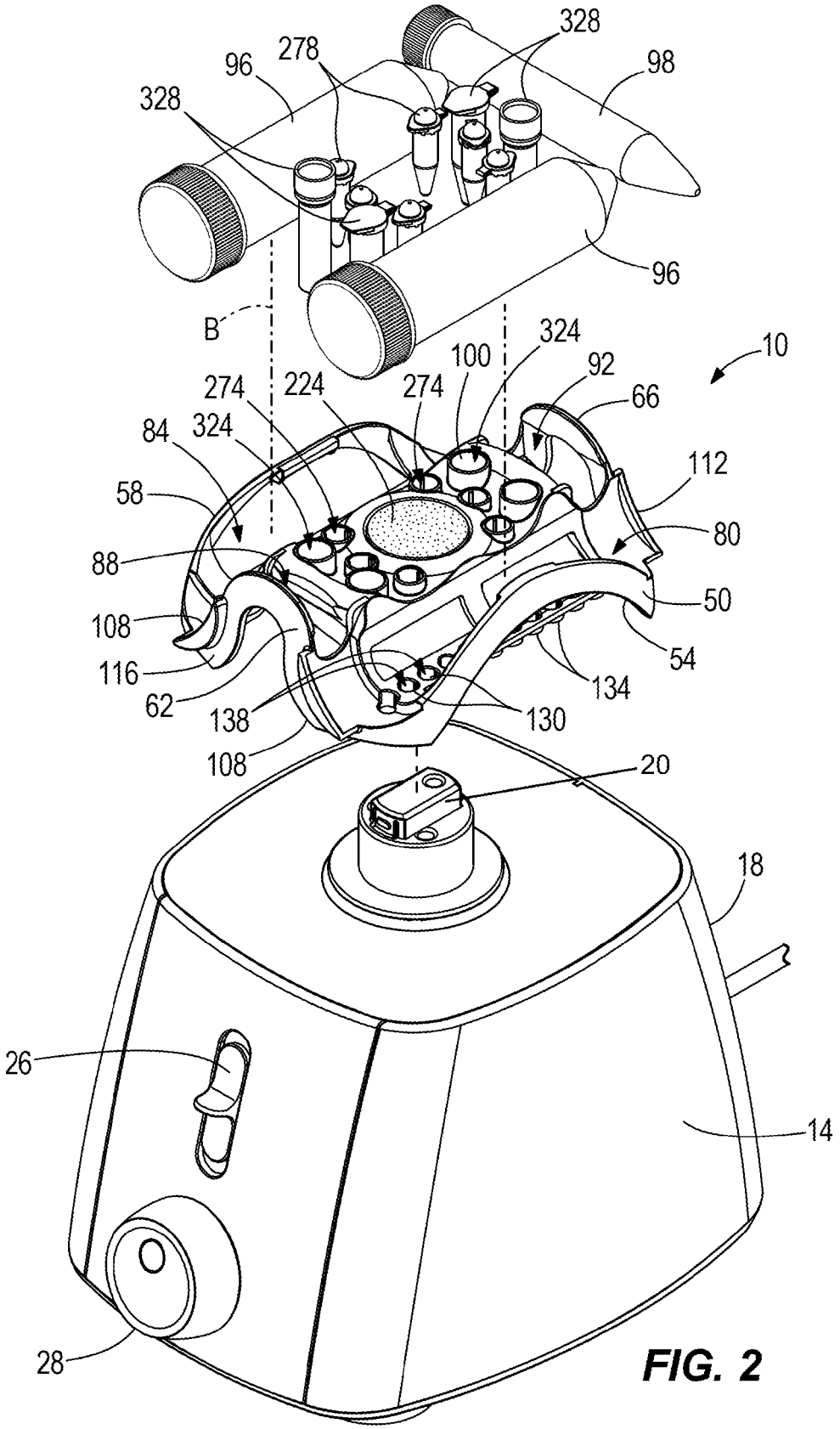
FIG. 2 is an exploded view of the mixing apparatus and head of FIG. 1.
Figure 3:
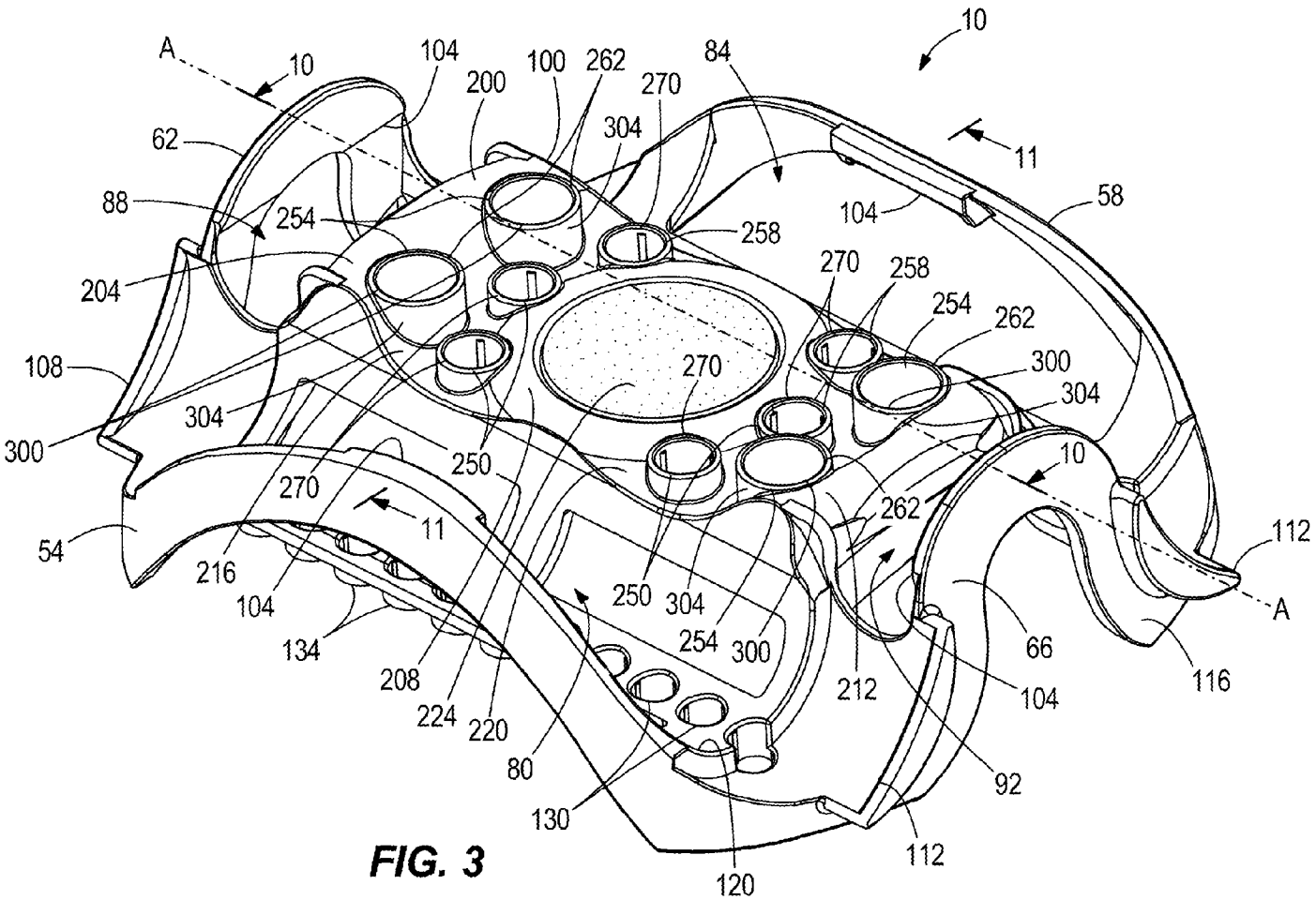
FIG. 3 is a perspective view of the head of FIG. 1.

Further with respect to FIGS. 2 and 3, the head 10 includes a body 50 that defines a longitudinal axis A and includes a first side 54, an opposite second side 58, a third or front side 62, and a fourth or rear side 66 opposite front side 62. A coupler 70 (FIGS. 5-11) extends from the body 50 and secures the head 10 to the housing 18 of the mixing apparatus 14. The body 50 defines one or more horizontal channels 80, 84, 88, 92 for holding test tubes. In the illustrated embodiment, the first horizontal 80 channel is defined in part by the first side 54, the second horizontal channel 84 is defined in part by the second side 58, the third horizontal channel 88 is defined in part by the third side 62, and the fourth horizontal channel 92 is defined in part by the fourth side 66. Each of the first, the second, the third, and the fourth sides 54, 58, 62, 66 is spaced apart from a central member or median 100 by the first, the second, the third, and the fourth horizontal channels 80, 84, 88, 92, respectively. Therefore, each of the first, the second, the third, and the fourth channels 80, 84, 88, 92 is also defined in part by the central member 100. Each of the first, the second, the third, and the fourth sides 54, 58, 62, 66 includes a projection or lip 104 that protrudes towards the central member 100. In the illustrated embodiment, the first and the second channels 80, 84 are each further defined by a first rib 108 and an opposing second rib 112 that extend from the third and the fourth sides 62, 66, respectively. The first and the second ribs 108, 112 are positioned at distal ends of the first and the second channels 80, 84.

Figure 10:
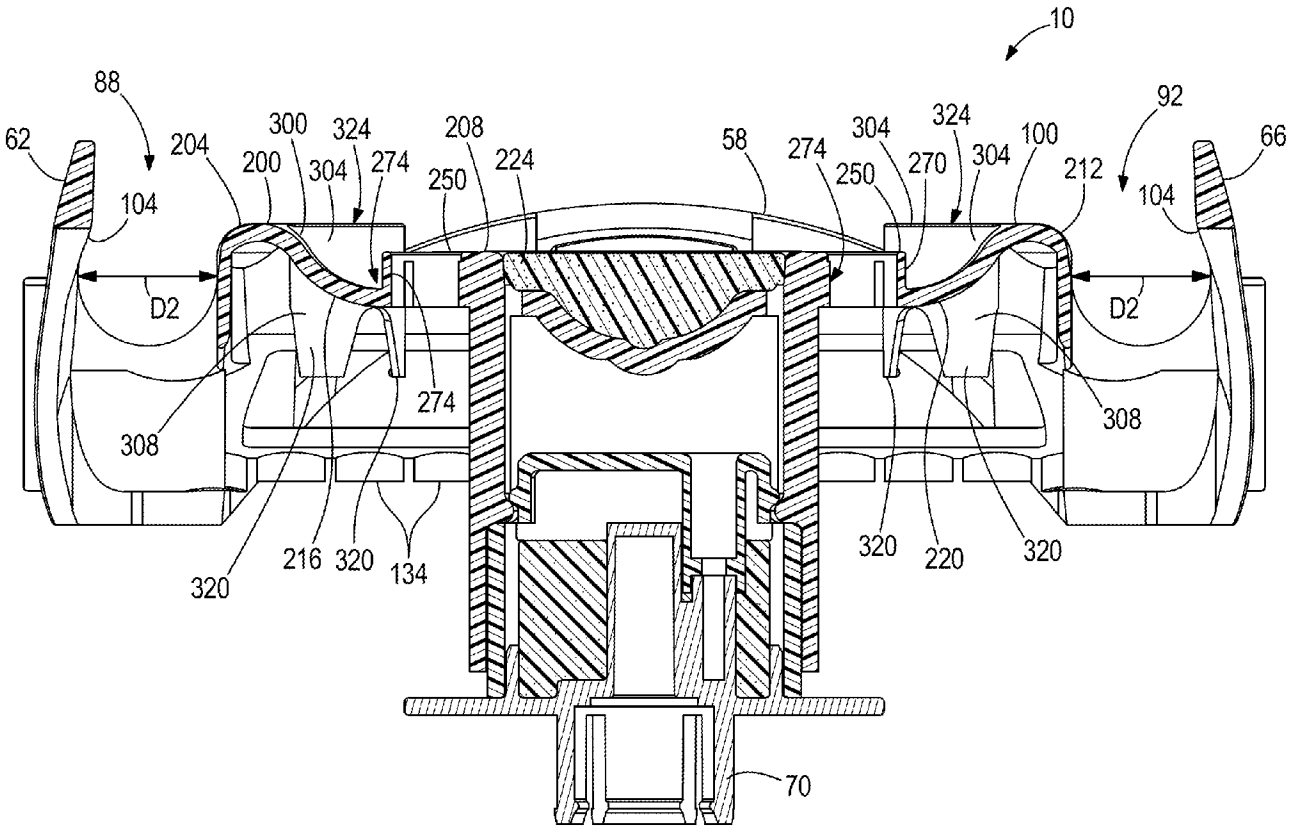
FIG. 10 is a first cross-sectional view of the head of FIG. 1 along line 10-10 of FIG. 3.
Figure 11:
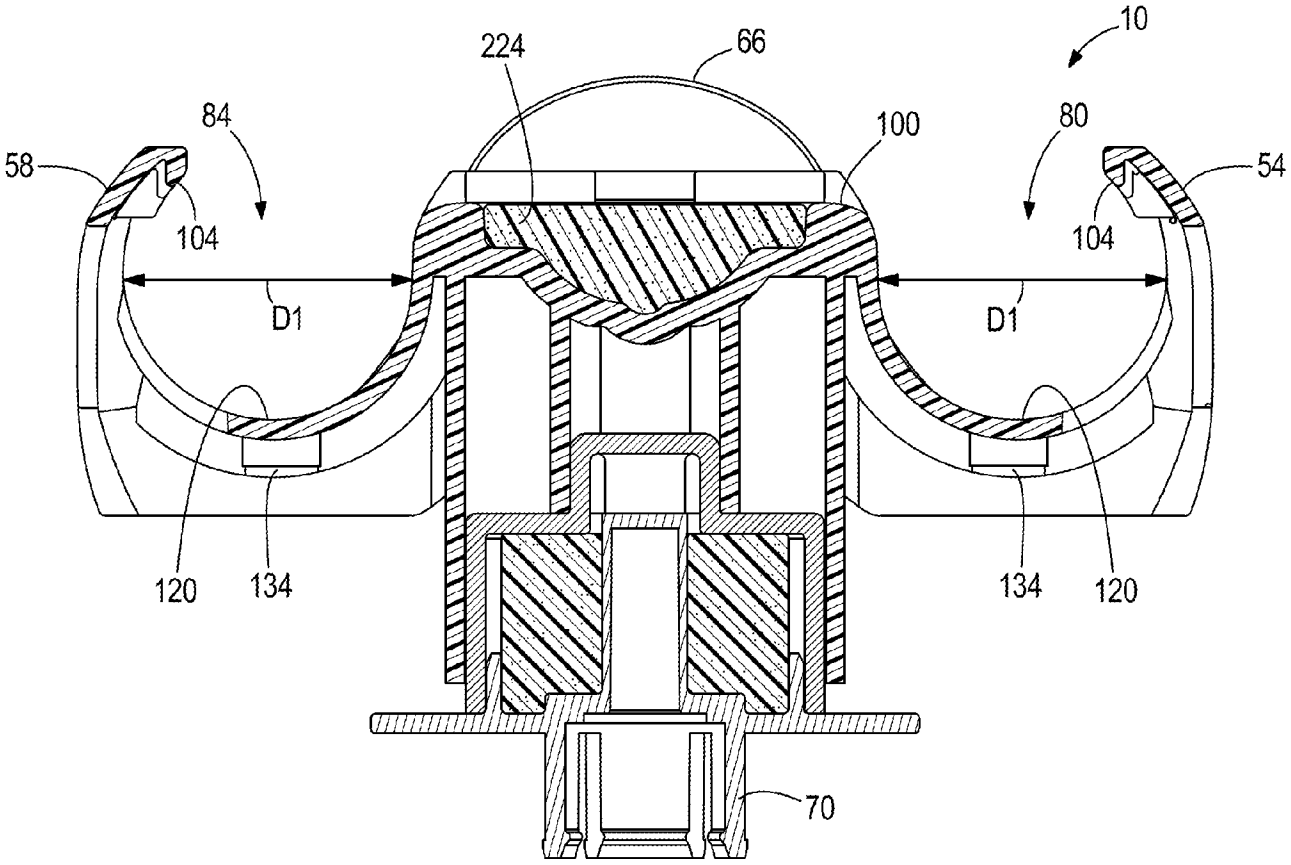
FIG. 11 is a second cross-sectional view of the head of FIG. 1 along line 11-11 of FIG. 3.

As illustrated in FIGS. 1-4, the first and the second channels 80, 84 are spaced apart from one another by the central member 100, and they longitudinally extend parallel to the longitudinal A axis. The third and the fourth channels 88, 92 are spaced apart from one another by the central member 100 and longitudinally extend perpendicular to the longitudinal axis A. As illustrated herein, the first, the second, the third, and the fourth sides 54, 58, 62, 66 are substantially arcuately shaped in cross section and are elastically deformable such that each of the first, the second, the third, and the fourth horizontal channels 80, 84, 88, 92 can removably receive and secure a test tube with a snap-fit engagement. The projection 104 on each of the first, the second, the third and the fourth sides 54, 58, 62, 66 engages and maintains the test tube within the respective channel 80, 84, 88, 92. The first and the second channels 80, 84 have a diameter D1 and are configured to removably receive and secure 50 ml test tubes 96 (FIG. 11). The third and the fourth channels 88, 92 have a diameter D2 and are configured to removably receive and secure 15 ml test tubes 98 (FIG. 10). The first and the second diameters D1, D2 are different from one another and could be differently sized to engage different size test tubes.

A bottom 120 of each of the first and the second sides 54, 58 includes a plurality of test tube apertures 130 that are configured to hold test tubes so that their longitudinal axes orient in a direction parallel to an axis B (FIG. 2) and in a direction that is perpendicular to the longitudinal axis A. Each of the apertures 130 includes a wall 134 (FIGS. 2, 3, 5, 7) that is positioned adjacent to and concentric therewith. The walls 134 project from the body 50 in a direction parallel with the axis B. In the illustrated embodiment, the walls 134 are substantially uniform in height, but in other embodiments the walls have varying heights. The apertures 130 and walls 134 define vertical channels 138 that have a diameter D3 (FIG. 4) and are configured to snugly and removably receive and secure 1 ml test tubes (not shown). The third diameter D3 may be different from the first and the second diameters D1, D2. Again, diameter D3 depends on the size of the test tubes to be held in them.

The central member 100 includes a top surface 200 having a non-uniform contour. In other words, the top surface 200 has raised regions 204, 208, 212 and depressed regions 216, 220. The central member 100 also includes a deformable pad 224 that is flush with one of the raised portions 208 of the top surface 200. The pad 224 is constructed from an elastomeric material such as polyurethane foam.

The central member 100 includes a plurality of test tube apertures 250, 254 that are also configured to hold test tubes so that their longitudinal axes orient in a direction parallel to the axis B and therefore, perpendicular to the longitudinal axis A. As illustrated FIG. 3, the central member 100 includes a pair of first rows 258, which contain the apertures 250, and a pair of second rows 262, which contain the apertures 254, with one of each of the rows 258, 262 on opposite sides of the pad 224.

Figure 4:
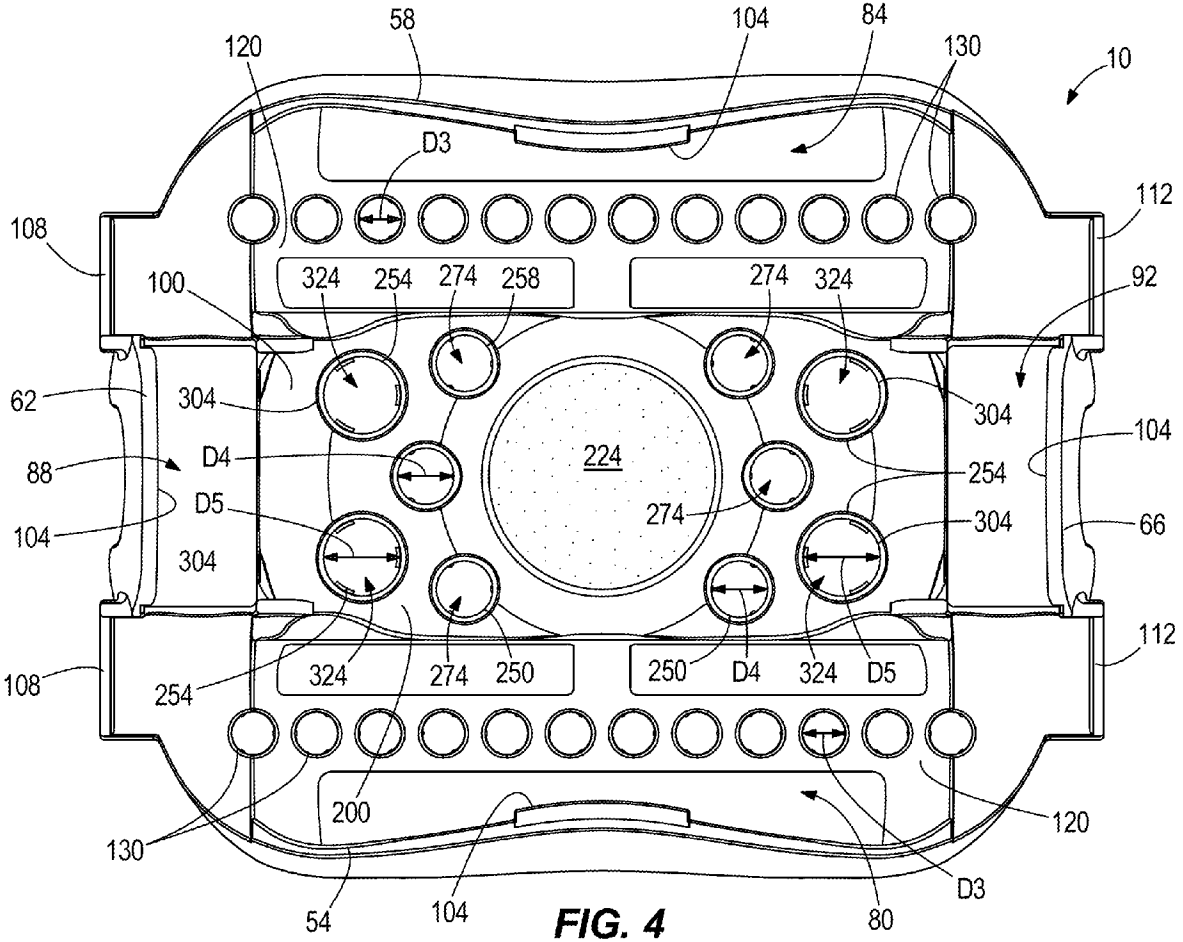
FIG. 4 is a top plan view of the head of FIG. 1.

The apertures 250 of the first row 258 each include an adjacent, concentric wall 270 that projects from the body 50 in a direction parallel to the longitudinal the axis B. The apertures 250 and the walls 270 each define a vertical channel 274 (FIG. 10) that extends along the axis B (e.g., perpendicular to the longitudinal axis A) and have a diameter (FIG. 4). The vertical channels 274 are configured to removably receive and frictionally engage 1.5 ml test tubes 278. The fourth diameter D4 is different from the first, the second, and, the third diameters D1, D2, D3. In the illustrated embodiment, the walls 270 of each aperture 250 have varying heights due to the different positions of each aperture 250 along the contoured top surface 200. The heights are selected so that top surfaces of all of the walls 270 are co-planar.

Figure 5:
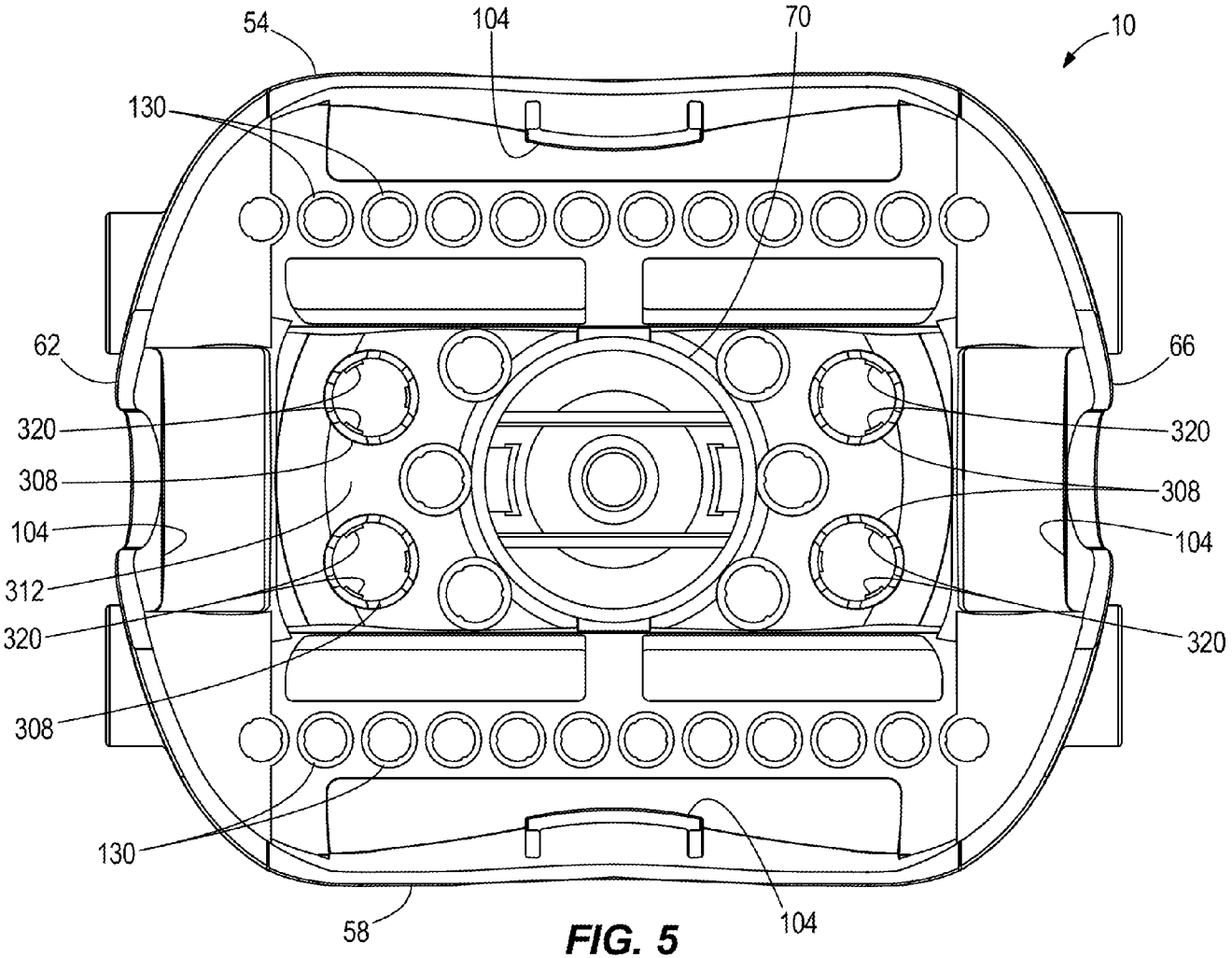
FIG. 5 is a bottom plan view of the head of FIG. 1.
Figure 6:
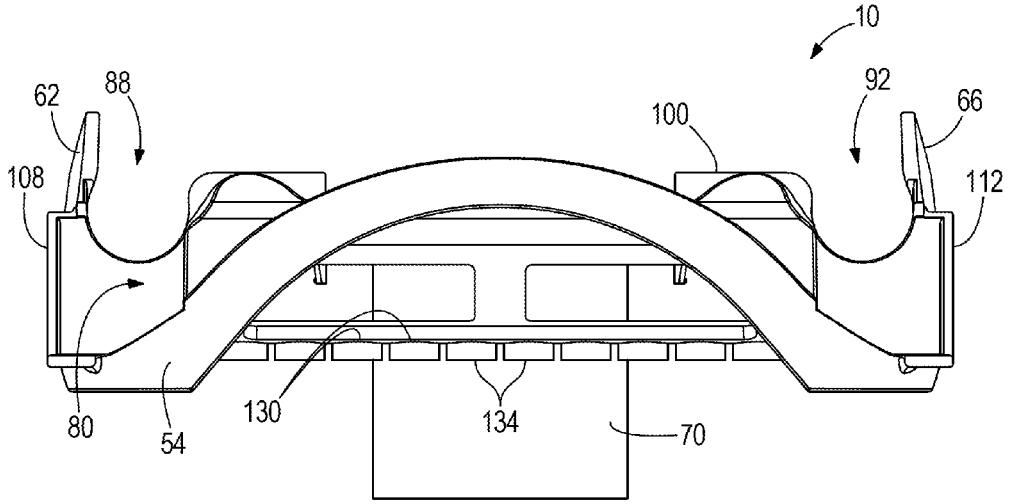
FIG. 6 is a first side elevation view of the head of FIG. 1.
Figure 7:
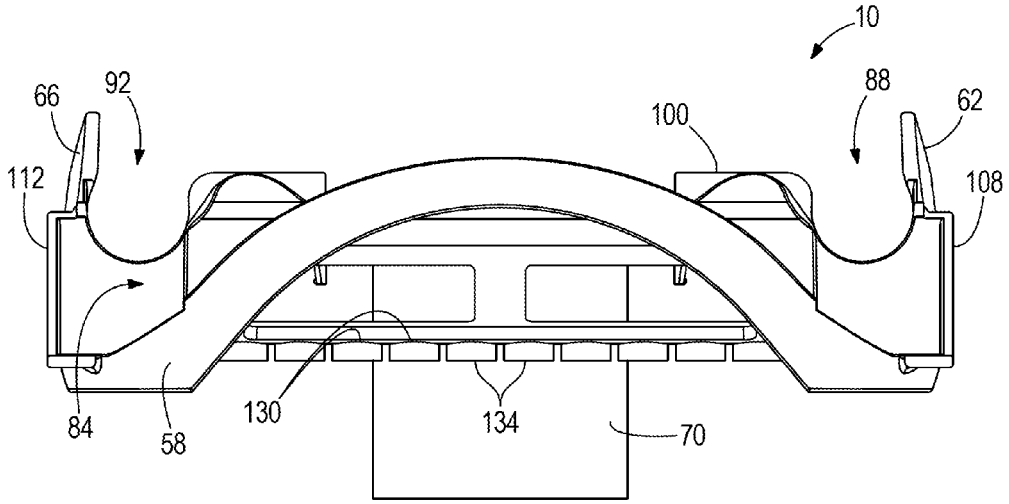
FIG. 7 is a second side elevation view of the head of FIG. 1.
Figure 8:
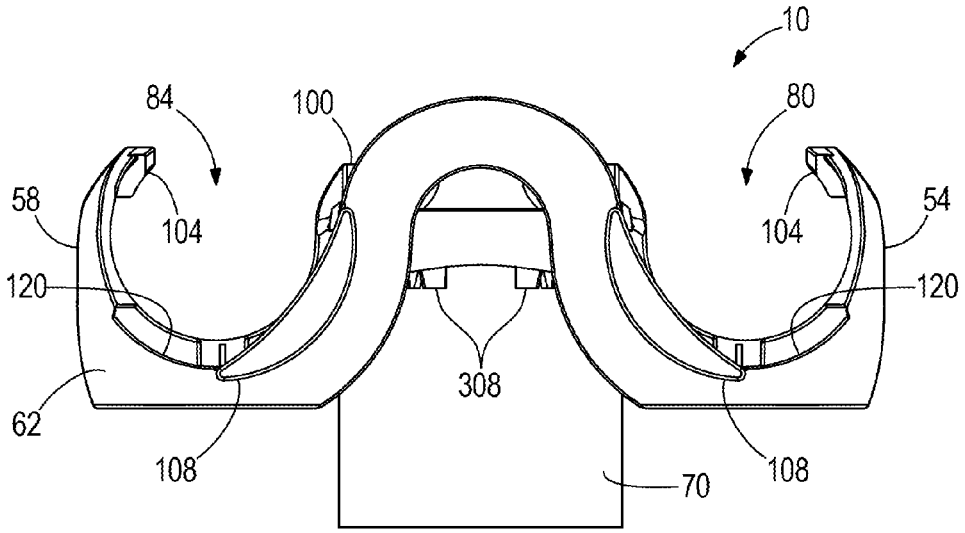
FIG. 8 is a front elevation view of the head of FIG. 1.
Figure 9:
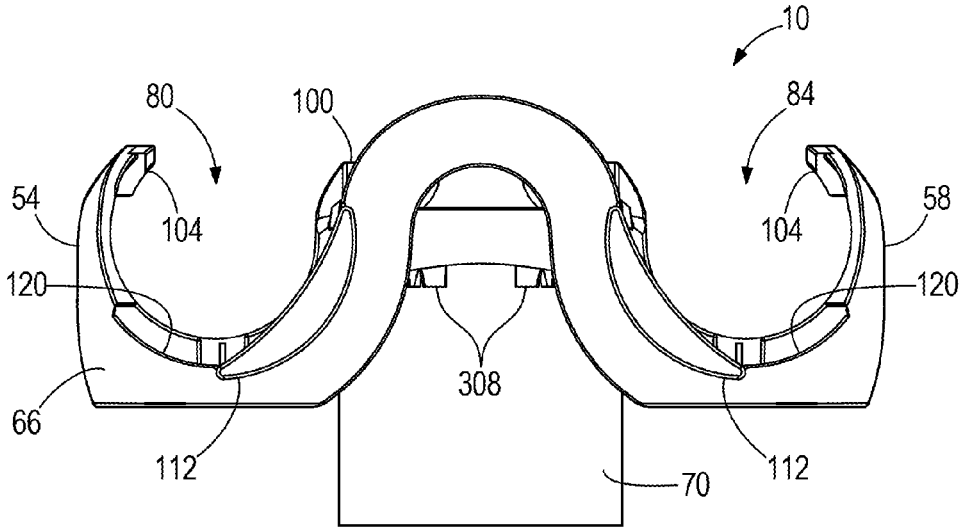
FIG. 9 is a rear elevation view of the head of FIG. 1.

The apertures 254 of the second row 262 each include an adjacent, concentric wall 300 that projects from the body 50 in a direction parallel to the longitudinal the axis B. The walls 300 of the apertures 254 in the second row 262 each include a first wall section 304 that is disposed above the top surface 200 of the central member 100 (FIGS. 3, 4, and 10) and a second wall section 308 that is disposed below a bottom surface 312 of the central member 100 (FIGS. 5 and 10). The first wall section 304 is continuous, while the second wall section 308 is discontinuous, thereby defining converging projections 320 (FIGS. 8-10). The projections 320 are biased towards a central of the respective aperture 254 and are also elastically deformable. The apertures 254 of the second rows 262 and the walls 300 define vertical channels 324 that have a diameter D5 of and are configured to removably receive and frictionally engage 2 ml test tubes 328 (FIG. 4). The fifth diameter D5 is different from the first, the second, the third, and the fourth diameters D1, D2, D3, D4. In the illustrated embodiment, the walls 300 of each aperture 254 have varying heights due to the different position of each aperture 254 along the contoured top surface 200. The heights are selected so that top surfaces of the walls 300 are all co-planar. The converging projections 320 ensure that the test tubes are securely retained within the vertical channels 324.

The body 50 is also configured to removably receive and frictionally engage a microplate 350. In particular, the first, the second, the third, and the fourth sides 54, 58, 62, 66 are elastically deformable and receive the microplate therebetween. The projections 104 on each of the first, the second, the third and the fourth sides 54, 58, 62, 66 engage and maintain the position of the microplate 350 relative to the body 50 and secure the microplate 350 with a snap-fit engagement. An auxiliary coupling mechanism (not shown) may additionally be used to secure the microplate 350 relative to the body 50. The auxiliary mechanism may be an elastic retention bands (not shown) that are pre-attached to the mixing head, for example.

To assemble the head and housing, the head 10 is secured (i.e., by a snap fit engagement or fastening system) to the housing 18 of the mixing apparatus 14. The rotor post sub-assembly 20 underlies the pad 224 and connects to a switch (not shown) in the housing for activating the motor 22. Once assembled, either the microplate 350 or one or more test tubes may be secured to the head 10. For example, the user can couple the microplate 350 to the head 10 between the first, the second, the third, and the fourth sides 54, 58, 62, 66 using one or more of the projections 104 on those sides. Alternatively, the user may slide one or more test tubes into one or more of the horizontal channels 80, 84, 88, 92 and one or more of the vertical channels 138, 274, 324. The head 10 is configured to receive several sizes of test tubes at the same time. In other words, the head 10 can receive, for example, a 50 ml test tube in one of the horizontal channels 80, 84 and a 15 ml test tube in another of the horizontal channels 88, 92 at the same time. Also, the head 10 can receive, for example, a 1 ml test tube in one of the vertical channels 138, a 1.5 ml test tube in another of the vertical channels 274, and a 2 ml test tube in yet a third of the vertical channels 324, all at the same time. Similarly, the head 10 can receive a test tube in one or more of the horizontal channels 80, 84, 88, 92 and a test tube in one or more of the vertical channels 138, 274, 324 at the same time. Once appropriately positioned, the motor 22 is actuated by the switch 26. Actuation of the motor 22 moves (e.g., translates, oscillates, or translates and oscillates) the head 10 relative to housing 18 to agitate the contents of the microplate 350 or of the one or more test tubes.

The head 10 is depressible relative to the housing 18 to manually actuate the motor 22, if switch 26 is in the intermittent position. In particular, when a manual force is applied to the pad 224, the pad 224 will move toward the sub-assembly 20 in the housing 18, thereby actuating the motor 22. Removal of the force causes the motor 22 to stop. Therefore, a user can, for example, press a bottom, closed end of a test tube into the pad 224 and actuate the motor 22. By holding the test tube against pad 224 while the motor is actuated, the contents of the test tube are agitated. Removing the test tube from the pad 224 shuts the motor off. If the switch 26 is at the "intermittent" position and the speed dial 28 is set to maximum, a vortex motion will be created within the contents of the test tubes held in or pressed against the head.

Various features and advantages of the invention are set forth in the following claims.

What is claimed is:

1. A head that can be coupled to a mixing apparatus, comprising:

a body defining a longitudinal axis and including a first side, a second side, a third side, and a fourth side, each of the sides including a projection, the body including a central member for supporting a microplate between the sides;

a first vertical channel defined by the body and configured to removably secure a first test tube so that its longitudinal axis is oriented perpendicular to the longitudinal axis of the body;

a second vertical channel defined by the body and configured to removably secure a second test tube so that its longitudinal axis is oriented perpendicular to the longitudinal axis of the body;

a first horizontal channel defined in part by the first side of the body and configured to removably secure a third test tube so that its longitudinal axis is oriented parallel to the longitudinal axis of the body;

a second horizontal channel defined in part by the third side of the body and configured to removably secure a fourth test tube so that its longitudinal axis is oriented perpendicular to the longitudinal axis of the body; and wherein each of the channels defines a channel diameter and at least one of the first vertical channel, the second vertical channel, the first horizontal channel, and the second horizontal channel defines a channel diameter that is different than the channel diameter of the remaining channels.

2. The head of claim 1, wherein the central member includes an elastomeric material.

3. The head of claim 2, wherein the elastomeric material is positioned relative to an actuator for the motor so that when the head is coupled to the housing and a force is exerted on the elastomeric member, the motor is actuated.

4. The head of the claim 1, wherein the at least one of the first horizontal channel and the second horizontal channel defines another vertical channel that is configured to removably secure a test tube to the body so that a longitudinal axis of the test tube orients in a direction perpendicular to the longitudinal axis of the body.

5. The head of claim 1, wherein the first and the second vertical channels each include an aperture in the body, converging projections, and a wall.

6. The head of claim 1, wherein the horizontal channels each secure a test tube with a snap-fit engagement.

7. The head of claim 1, wherein the sides are substantially arcuately shaped in cross section and at least partially define at least one of the first horizontal channel or the second horizontal channel.

8. The head of claim 1, wherein the projection of at least one of the sides is configured to engage a microplate with a snap-fit engagement.

* * * * *